US007243666B2

(12) United States Patent
Carroll

(10) Patent No.: US 7,243,666 B2
(45) Date of Patent: Jul. 17, 2007

(54) WALKER INCLUDING SUPPORTS FOR CARRYING OXYGEN BOTTLES

(76) Inventor: Donald K. Carroll, 2352 48th St. NE., Canton, OH (US) 44705

( * ) Notice: Subject to any disclaimer, the term of this patent is extended or adjusted under 35 U.S.C. 154(b) by 0 days.

(21) Appl. No.: 11/158,581

(22) Filed: Jun. 22, 2005

(65) Prior Publication Data

US 2006/0016466 A1 Jan. 26, 2006

Related U.S. Application Data

(60) Provisional application No. 60/589,323, filed on Jul. 20, 2004.

(51) Int. Cl.
*A61H 3/04* (2006.01)

(52) U.S. Cl. ..... 135/67; 135/66; 224/407; 224/42.39; 280/47.35

(58) Field of Classification Search ..... 135/67, 135/85, 66, 65; 280/47.35, 304.1; 297/188.02; 224/407, 42.39

See application file for complete search history.

(56) References Cited

U.S. PATENT DOCUMENTS

| | | | | |
|---|---|---|---|---|
| 3,970,344 | A * | 7/1976 | Baumann | 297/188.02 |
| 4,045,044 | A | 8/1977 | Bierer | |
| 4,251,044 | A * | 2/1981 | Olson | 248/166 |
| 5,476,432 | A * | 12/1995 | Dickens | 482/67 |
| D441,694 | S | 5/2001 | Kjell et al. | |
| 6,503,176 | B2 | 1/2003 | Kuntz | |
| 6,672,321 | B2 * | 1/2004 | Hamilton | 135/67 |
| 8,672,321 | | 1/2004 | Hamilton | |
| 2003/0127121 | A1 * | 7/2003 | Hamilton | 135/67 |
| 2004/0129305 | A1 * | 7/2004 | Hamilton et al. | 135/67 |

* cited by examiner

*Primary Examiner*—J. Allen Shriver
(74) *Attorney, Agent, or Firm*—Sand & Sebolt

(57) ABSTRACT

A walker for assisting physically challenged persons to move around. The walker comprises a frame with wheels mounted on it for traveling over a surface. Oxygen tank supports are mounted on the seat and are adapted to receive oxygen bottles therein. A counterbalance is mounted on the frame to counteract the weight of any oxygen bottles received in the tank supports and thereby maintain the stability and balance of the walker.

20 Claims, 7 Drawing Sheets

WALKER INCLUDING SUPPORTS FOR CARRYING OXYGEN BOTTLES

CROSS-REFERENCE TO RELATED APPLICATIONS

This application claims priority from U.S. Provisional Patent Application Ser. No. 60/589,323, filed Jul. 20, 2004, the entire specification of which is incorporated herein by reference.

BACKGROUND OF THE INVENTION

1. Technical Field

This invention generally relates to devices for assisting people with medical or physical problems who require a source of oxygen to remain ambulatory. More particularly, the invention relates to a device which can be used by the person to aid them in walking and which includes supports for retaining oxygen bottles or tanks. Specifically, the invention relates to a foldable walker that provides support for the person when walking, which may include a seat to allow the person to rest; which includes supports for carrying oxygen bottles and a counterbalance to keep the center of gravity of the walker low enough to prevent the walker from tipping over during use.

2. Background Information

A number of mobility devices have been proposed in the prior art for assisting people to move around when they have either a physical or medical problem. A number of these prior art devices include supports for holding oxygen bottles. Oxygen bottles are long and heavy and tend to affect the center of gravity of walkers, wheel chairs and other mobility-aiding devices, making them unstable and prone to tipping over. This tendency to tip over is especially problematic because of the physically-challenged nature of the user of the mobility device. Furthermore, the users of mobility devices may not be physically capable of walking long distances and consequently the devices have to be strong enough to support the person. As a result, the devices proposed in the prior art have tended to be large, unwieldy structures which occupy a large amount of space when they are not in use and which fairly frequently require the user to have assistance to get into them.

A first prior art device is disclosed in U.S. Pat. No. 4,251,044, issued to Olson. The Olson device has a collapsible frame and a telescoping support for an intravenous drip and includes an oxygen tank support mounted on a horizontal crossbar on the frame. An armrest is the only support mechanism provided for the user to hold onto the device but, because of the compromised health of the user, this armrest is inadequate to help the user remain upright and to be able to walk with security, confidence and safety while manipulating the device over a surface. The device does allow the person to receive oxygen as they walk along but does not provide a seat for the person to sit down on and take a rest when needed. Furthermore, the positioning of the oxygen tank close to the ground and inside the enclosure formed by the frame members, makes the insertion and removal of the oxygen tank fairly difficult for someone with limited or restricted movement or strength, i.e., for the person who typically needs a walker with oxygen.

A second device is shown in U.S. Pat. No. 5,476,432, issued to Dickens. This device does have adequate support for the person to hold onto as they move, but the walker is not collapsible for storage purposes. The device may also be provided with either a sling-type seat or a bicycle-type seat.

The seat, when provided, however, extends into the space where the person would need to stand in order to be able to walk. The seat therefore substantially prevents the person from walking and furthermore prevents the person from alternating walking and resting because the seat cannot be easily moved out of the way. This device is also fairly complicated and requires the person to have assistance in order to get into and out of the device. Additionally, because the device includes a support for an oxygen tank on only one side of the walker, the device needs to have four wheels and a fairly wide wheelbase in order to prevent it from tipping over. The provision of two front wheels with a wide wheel base makes the device difficult to maneuver through doorways and around furniture.

A third device is shown in U.S. Pat. No. 4,045,044, issued to Bierer. The device is essentially a wheelchair which includes supports for two oxygen bottles. The tank supports are positioned on the opposite sides of the frame. The tanks are held where their centers of gravity are below the center of gravity of the wheelchair when the patient is sitting therein. The Bierer device is not collapsible, the seat is welded into position and may only be adjusted vertically. Furthermore the seat cannot be pivoted out of the way so that the patient can walk using members 14 and 15 as supports. The person can therefore only use the device as a wheelchair. The positioning of the oxygen bottles close to the ground may make the wheelchair stable, but also makes it extremely difficult for an ill or disabled individual to insert or remove oxygen bottles.

A fourth prior art device is disclosed in U.S. Pat. No. 6,503,176, issued to Kuntz. The Kuntz device is a non-collapsible walker which includes a support for an oxygen tank secured near the front and bottom of the frame. The position of the support maintains a lower center of gravity for the walker, but again makes it more difficult to insert and remove an oxygen tank. The walker also includes leg supports through which the legs of the person are received and these supports are used to carry some or all of the person's weight. The supports appear to be fairly insubstantial and provide no place for the buttocks to rest. It is likely that an elderly, sick or disabled person would feel uncomfortable relying on these insubstantial supports to hold them up if they need to take a break from walking. Furthermore, in order for an elderly, sick or disabled person to use the walker, they would have to have assistance to insert their legs into the supports.

A fifth prior art device is disclosed in U.S. Pat. No. 6,672,321 issued to Hamilton. The Hamilton device is a walker which includes an U-shaped frame having an open-topped canvas bag hanging from the center of the front support of the walker. The canvas bag is adapted to carry an oxygen tank. The walker does not include a seat and is not collapsible for storage. Furthermore, the flexibility of the canvas bag may be problematic for an elderly or infirm patient who may not have the strength to manipulate a heavy oxygen tank into and out of the bag.

A sixth prior art device is disclosed in U.S. Pat. No. D441,694, issued to Kjell et al. This walker includes handles for the person to hold onto while walking and a seat for resting. The device does not, however, include supports for oxygen bottles.

There are many devices disclosed in the prior art for assisting people who are medically or physically disabled. However, there still exists a need in the art for a device which will assist a person in moving around independently, which collapses for storage, has a reduced tendency to tip over and which may hold oxygen bottles in a manner that makes it easier for a physically challenged person to insert and remove the tanks from the device.

SUMMARY OF THE INVENTION

The device of the present invention comprises a walker that includes supports for oxygen bottles and a counterbalance for reducing the walker's tendency to tip over. A first embodiment of the invention comprises a substantially triangular frame when in the operative position, with one front wheel and two rear wheels mounted thereon. Two tank supports for oxygen bottles are mounted proximate the front wheel of the walker and a counterbalance is mounted proximate the rear wheels of the walker. The spacing between the tank supports and the counterbalance aids in reducing the walker's tendency to tip over. A second embodiment of the device has four wheels and includes a seat with a pair of tank supports mounted proximate one end of the seat. A counterbalance is mounted to seat and is disposed below the seat. The counterbalance ensures that the oxygen bottles do not cause the center of gravity of the walker to shift to an unsafe position where the walker may tip over. The relative height of the tank supports on the seat makes it easier for elderly or infirm persons to insert and remove the oxygen bottles.

BRIEF DESCRIPTION OF THE DRAWINGS

The preferred embodiment of the invention, illustrative of the best mode in which applicant has contemplated applying the principles, is set forth in the following description and are shown in the drawings and are particularly and distinctly pointed out and set forth in the appended claims.

DETAILED DESCRIPTION OF THE INVENTION

Figure 1:
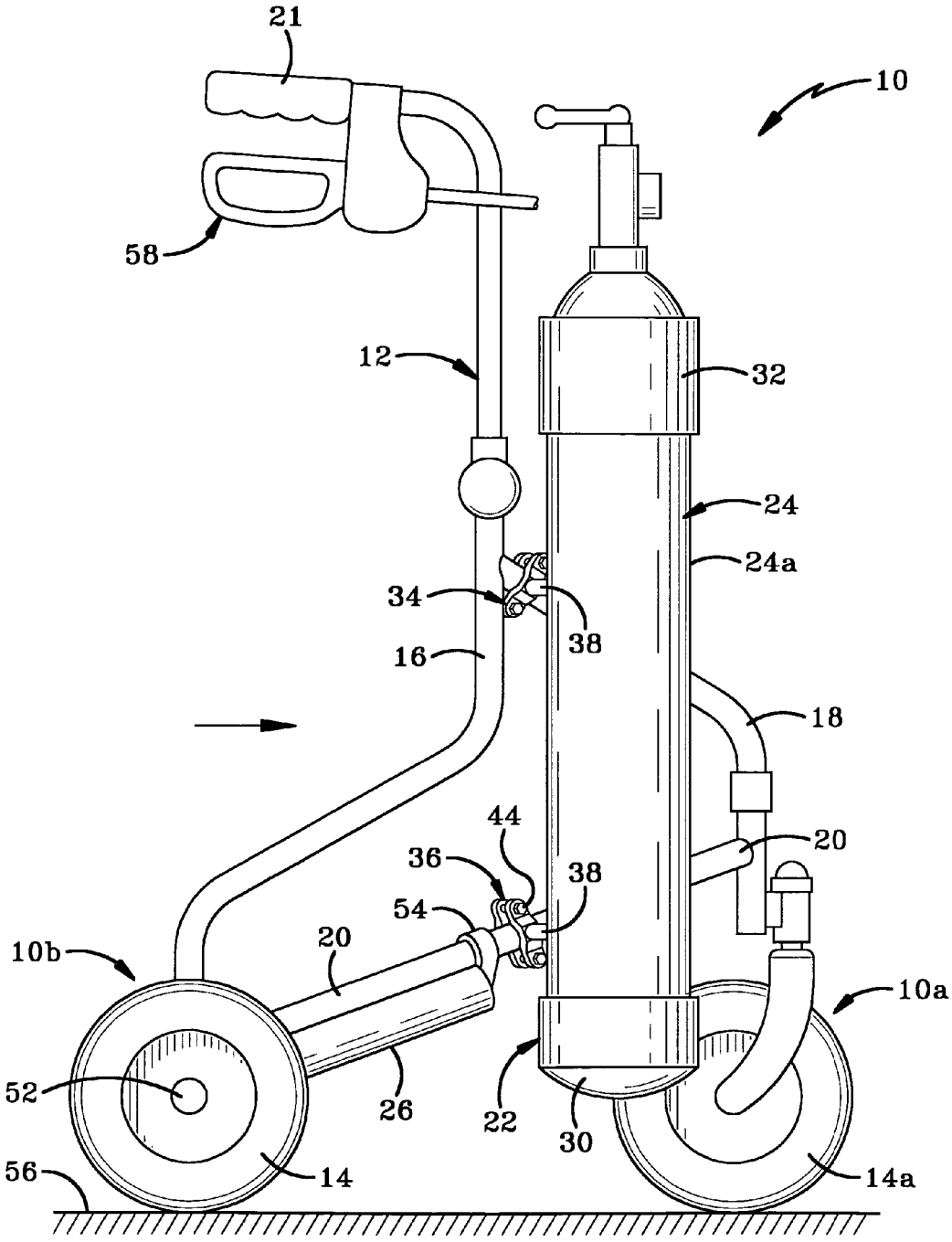
FIG. 1 is a side elevational view of a first embodiment of a walker in accordance with the present invention, showing the counterbalance and an oxygen tank mounted thereon.
Figure 2:
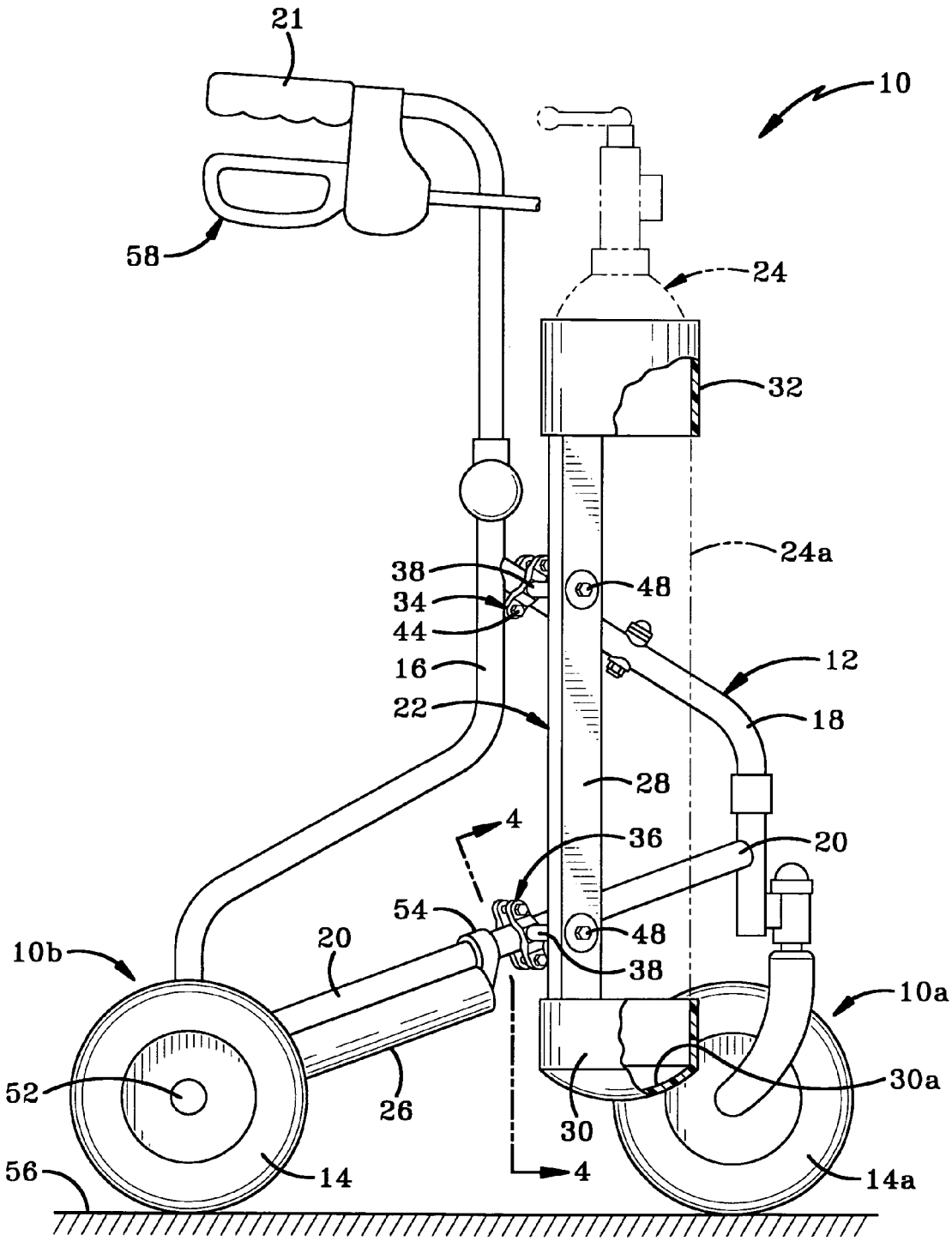
FIG. 2 is a side view of the walker of FIG. 1 showing the oxygen tank in phantom.

Referring to FIGS. 1–4, there is shown a first embodiment of a walker in accordance with the present invention and generally indicated at 10. Walker 10 includes a frame 12 onto which three wheels 14 are mounted. Frame 12 is made up of first, second and third struts 16, 18 and 20 which are connected together in a manner that allows walker 10 to be folded up for storage. Handles 21 are provided on one end of first struts 16. Tank supports 22 are secured to second and third struts 18, 20 and are adapted to receive oxygen bottles 24 therein. A counterbalance 26 is mounted on each of the third struts 20. As will be understood by those skilled in the art, the size and weight of counterbalance 26 should complement the combination of the weight of filled oxygen bottles 24 to be received in tank support 22 and the height at which tank support 22 is mounted on frame 12 so as to counteract the tendency of walker 10 to tip over.

In accordance with a specific feature of the present invention, each tank support 22 comprises a support bar 28 (FIG. 2) which has a cupped support 30 mounted at one end and a ring support 32 mounted proximate the opposite end thereof. When an oxygen bottle 24 is retained in tank support 22, the bottom (not shown) of bottle 24 is received within cupped support 30 and rests on the interior surface 30*a* thereof. Bottle 24 is kept in an upright position by ring support 32 engaging a portion of side wall 24*a* of bottle 24.

Figure 3:
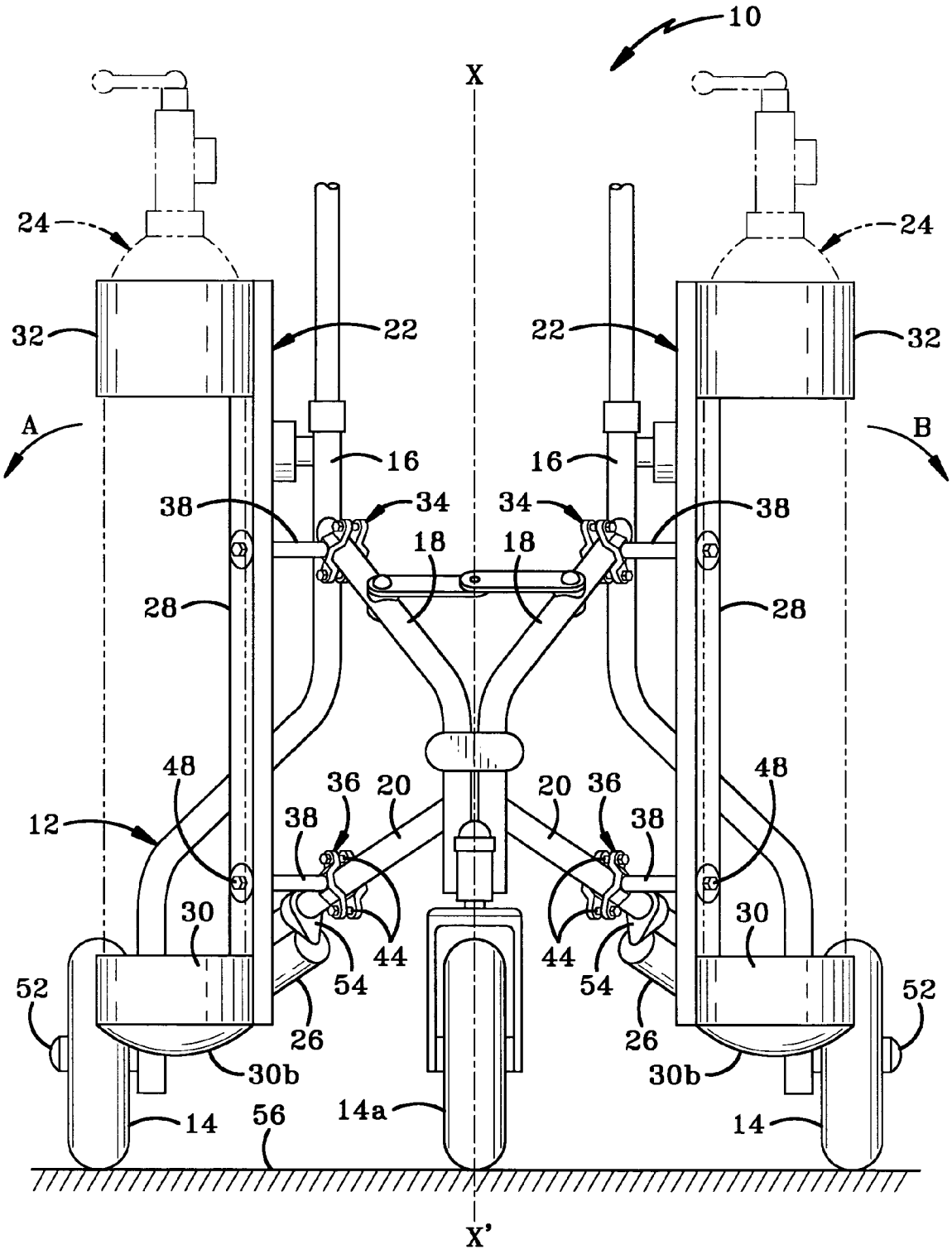
FIG. 3 is a front view of the walker showing both tank mounts and counterbalances and showing the oxygen bottles in phantom.
Figure 4:
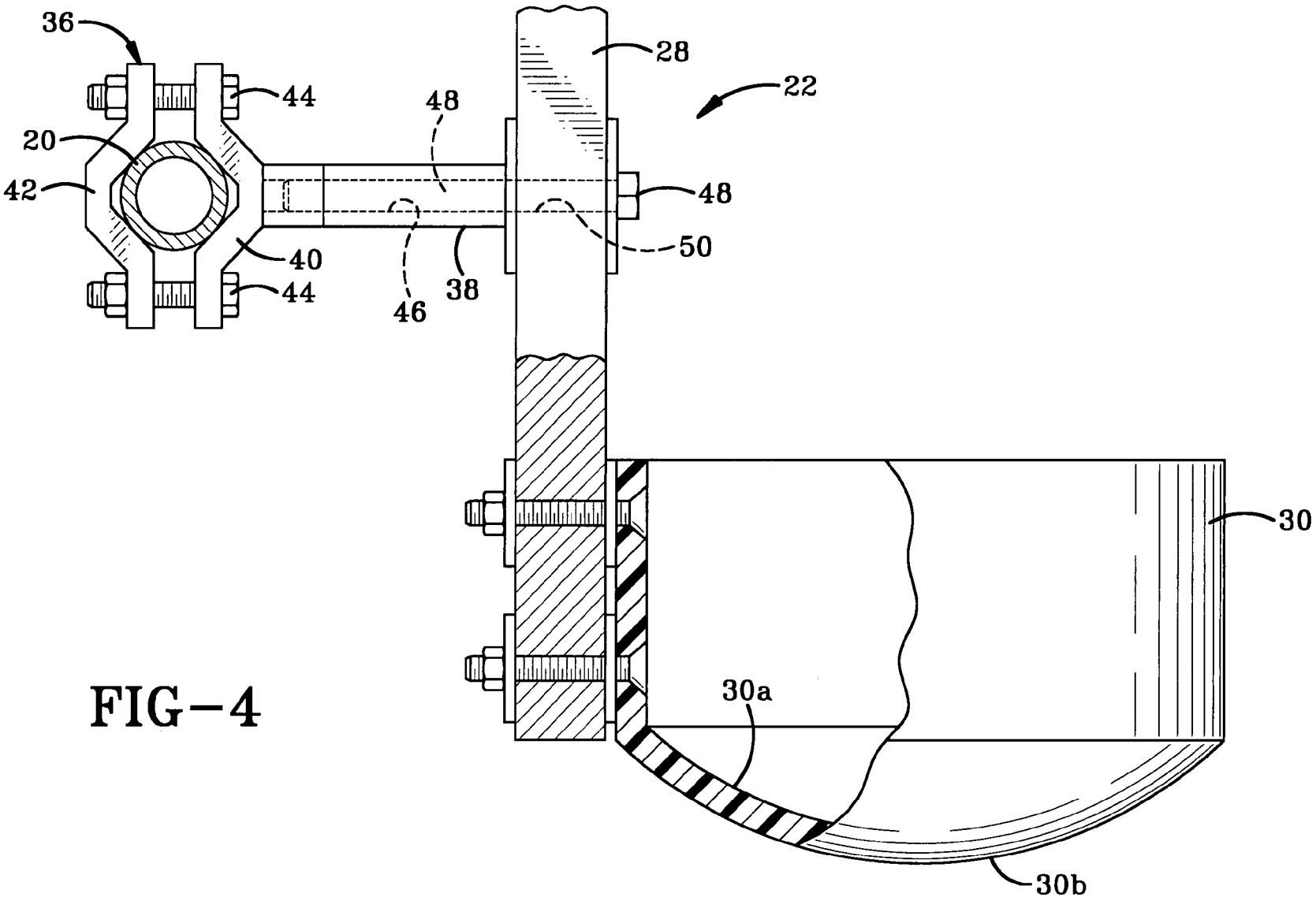
FIG. 4 is a rear view of the mounting mechanism for the tank support taken through line 4—4 in FIG. 2.

Referring to FIGS. 3 & 4, tank supports 22 are secured to walker 10 by a pair of clamping members 34, 36 that engage second and third struts 18, 20 respectively. Clamping members 34 and 36 are substantially identical to each other. The following description relates to clamping member 36, but applies equally to clamping member 34. Clamping member 36 comprises an arm 38 and two opposing plates 40, 42. Plate 40 and arm 38 are secured together by welding or some other suitable mechanism. Plates 40 and 42 are substantially "V" shaped and are movably connected together by bolts 44. Plates 40, 42 can be moved toward each other to clamp around a tubular member, such as third strut 20. Plates 40, 42 can be moved outwardly away from each other to release a tubular member, such as third strut 20, from between the plates. Plates 40, 42 are moved toward each other by turning threaded bolts 44 in a first direction and moved away from each other by turning bolts 44 in the opposite direction. Arm 38 includes an internal axial bore 46 and is mounted onto support bar 28 by a bolt 48 which is inserted through an aperture 50 in bar 28 and then into bore 46. Clamping member 34 is substantially identical in construction to clamping member 36 and is secured to an upper end of bar 28 in substantially the same way. The relative positions of clamping members 34, 36 on second and third struts 18, 20 is adjustable to enable tank supports 22 and therefore oxygen bottles 24, to be held substantially vertical on walker 10. Furthermore, tank supports 22 are mounted in a position that keeps the center of gravity of walker 10 as low as possible. As may be seen from FIG. 3, the bottoms 30*b* of cupped supports 30 preferably are positioned to lie at about the same height as the axles 52 of wheels 14. Furthermore, arms 38 allow bar 28 to be mounted further away from the centerline X–X' (FIG. 3) of walker 10 than would be possible if arms 38 were not provided. This distributes the weight of oxygen bottles 24 more evenly and improves the stability of walker 10 thereby reducing the tendency of walker 10 to tip over sideways in the direction of either Arrow "A" or "B".

In accordance with another specific feature of the present invention, counterbalances 26 are secured to the lowermost section of each of third struts 20. Counterbalances 26 preferably are substantially solid weights that are secured to third struts 20 by securing bands 54. Counterbalances 26 may alternatively be bolted or welded onto third struts 20. Counterbalances 26 assist in keeping a low center of gravity for walker 10. Furthermore, because tank supports 22 are mounted proximate the front end 10*a* of walker 10 and counterbalances 26 are mounted proximate the rear end 10*b* of walker 10, the weight of walker 10 is more evenly distributed and this tends to reduce the walker's tendency to tip forward. This is especially true when oxygen bottles 24 are inserted into tank supports 22.

In use, walker 10 is in the open position shown in FIG. 3. An oxygen bottle 24 is inserted through a ring support 32 of one of tank supports 22. Bottle 24 slides through ring support 32 until the bottom (not shown) of bottle 24 rests on the interior surface 30*a* (FIG. 2) of cupped support 30. Hoses (not shown) are connected to bottles 24 in a conventional manner so as to allow the user of the walker to obtain oxygen from bottles 24. Handles 21 can be used to push walker 10 over a surface 56. Front wheel 14*a* is designed to swivel to allow the walker 10 to be easily moved over surface 56 and around obstacles (not shown). Counterbalances 26 assist in keeping walker 10 balanced as the user moves walker 10 across surface 56. Counterbalances 26 further assist in maintaining the walker's position on surface 56 when oxygen bottles 24 are lifted into and out of tank supports 22. Walker 10 preferably is also provided with a braking system 58 (not shown in detail) to stop and lock walker 10 in position when bottles 24 are being removed or inserted or when the user wishes to maintain their position on surface 56.

Figure 5:
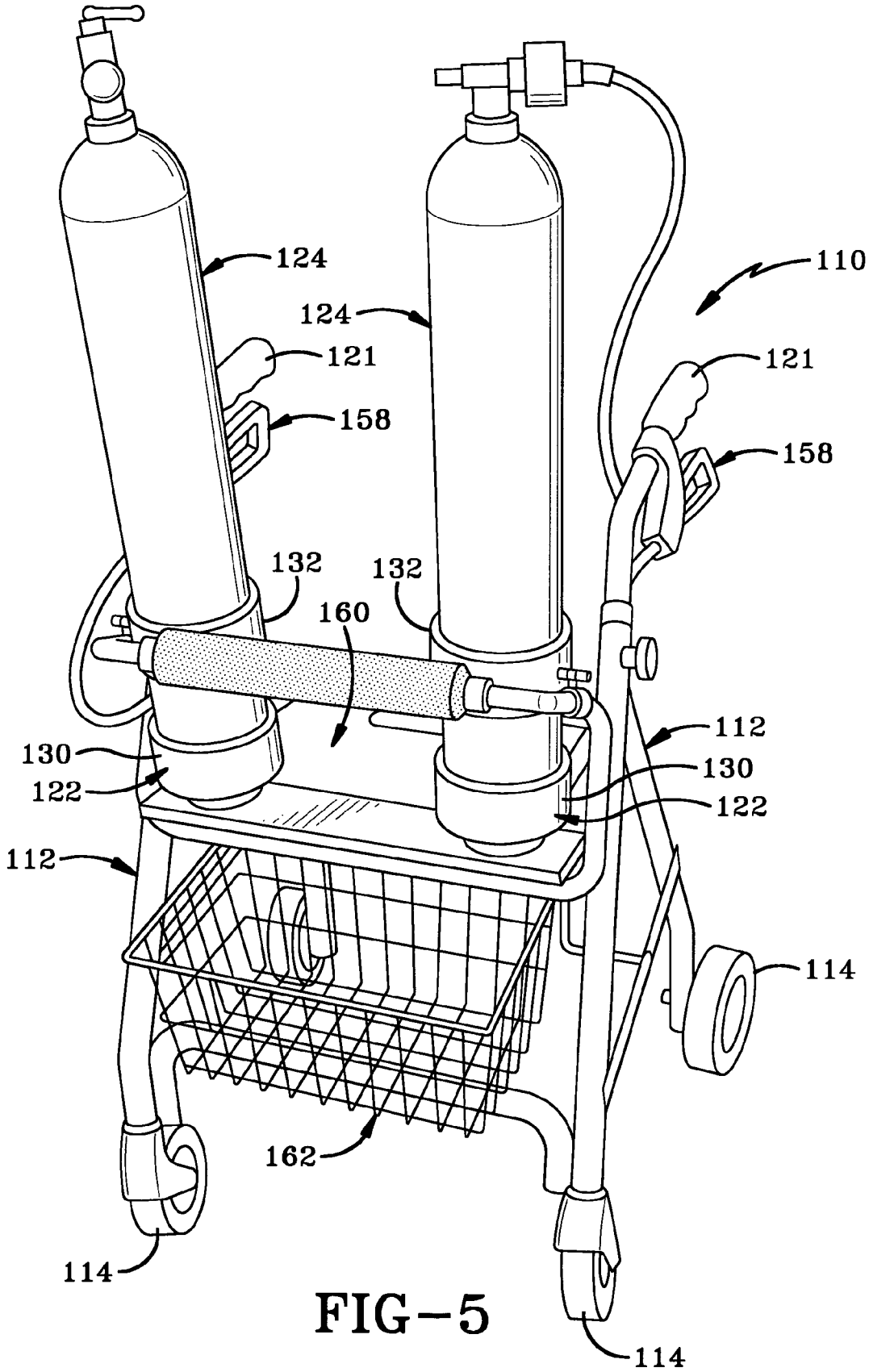
FIG. 5 is a perspective view of a second embodiment of the walker in accordance with the present invention, showing two oxygen bottles mounted on the walker seat.
Figure 6:
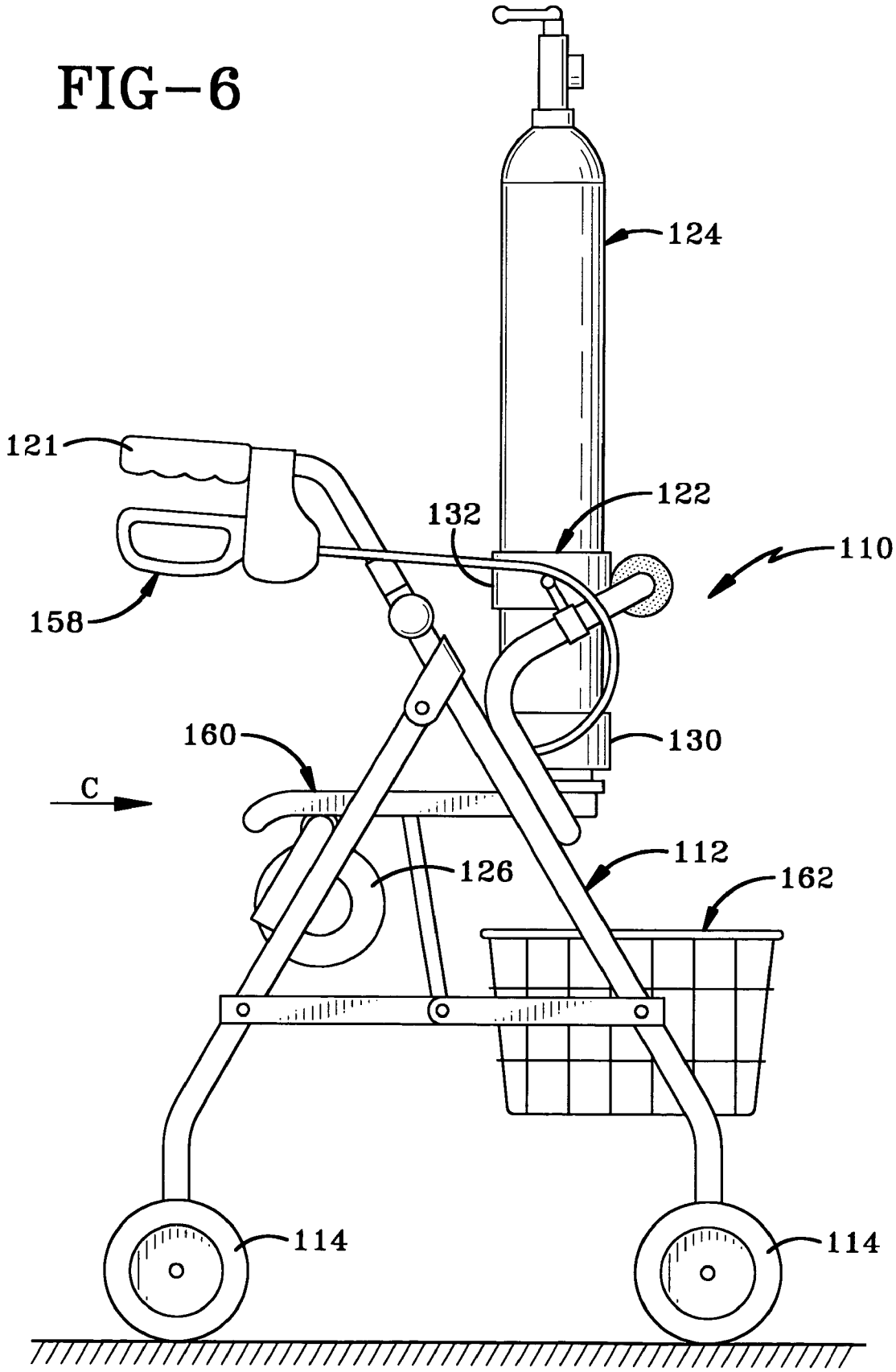
FIG. 6 is a side view of the walker of FIG. 5 showing the counterbalance mounted on the opposite end of the seat from the tank mounts.
Figure 7:
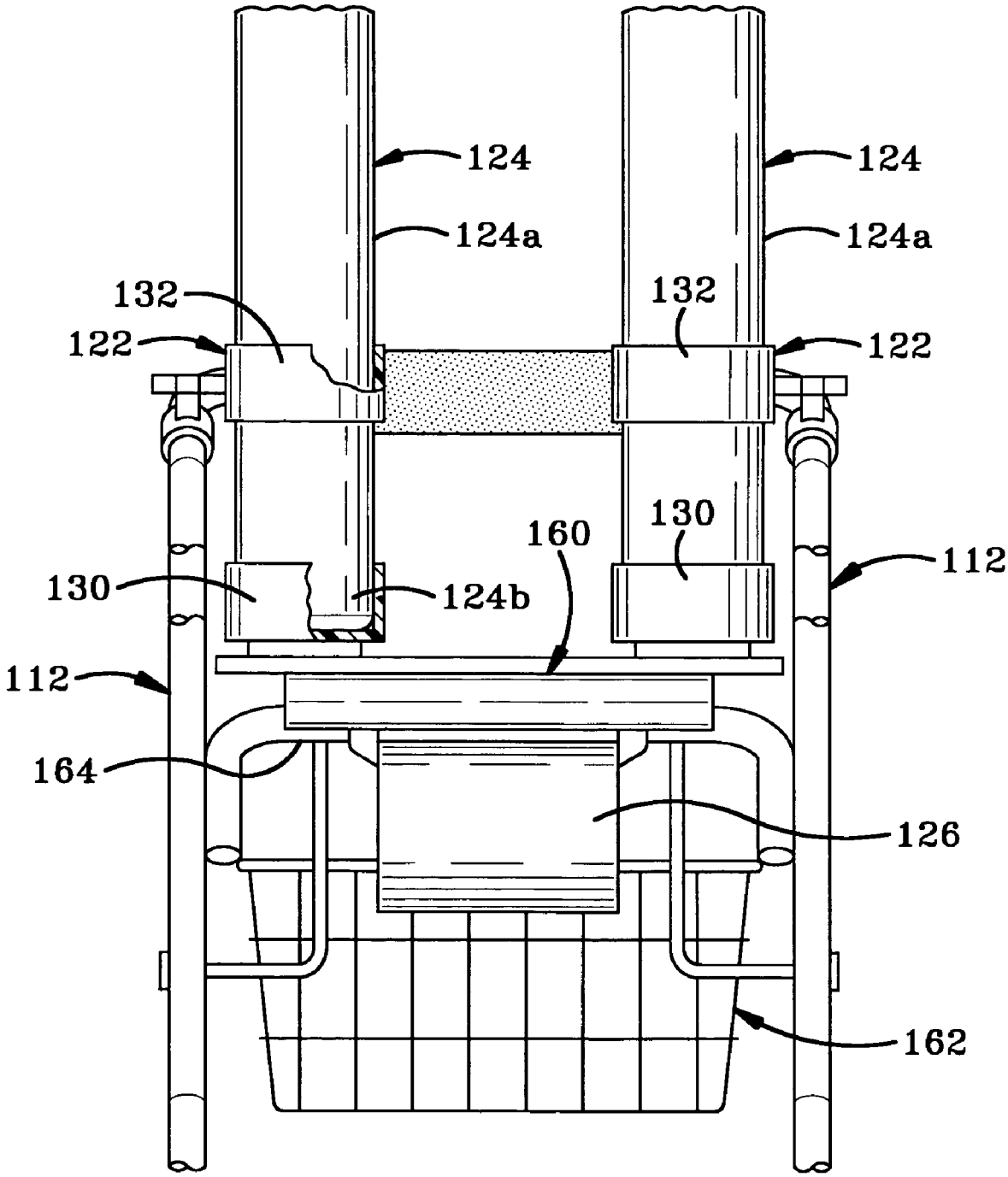
FIG. 7 is a partial rear view of the walker with the oxygen bottles removed.

Referring to FIGS. 5–7, there is shown a second embodiment of a walker in accordance with the present invention and generally indicated at 110. Walker 110 comprises a frame 112 with four wheels 114 mounted thereon and includes tank supports 122 and a counterbalance 126 (FIGS. 6 & 7). Walker 110 further includes a seat 160 for the user and tank supports 122 preferably are secured to seat 160 and to frame 112. A basket 162 may be provided on frame 112 for carrying personal articles (not shown). Frame 112 of walker 110 is designed to be foldably collapsible for storage purposes. Walker 110 is also provided with handles 121 and with a braking system 158.

In accordance with one of the specific features of the present invention, tank supports 122 mounted on seat 160 comprise a ring support 132 and a cupped support 130. Alternatively, tank supports 122 may comprise two spaced apart ring supports (not shown). Cupped supports 130 are mounted to an upper surface of seat 160, proximate one end thereof. Ring supports 132 are secured to a portion of frame 112 so that they are axially aligned with the cupped supports 130 on seat 160. Ring support 132 and cupped support 130 are sized to abut the outer surface 124*a* of oxygen bottles 124 (FIG. 7). This reduces the tendency of bottles 124 received therein to rattle in supports 132, 130 and to have the weight of bottles 124 shift around therein and thereby potentially destabilize walker 110.

In accordance with another of the specific features of the invention, counterbalance 126 is mounted on a crossbar 164 extending from the underside of seat 160. Counterbalance 126 is mounted at the opposite end of seat 160 from cupped supports 130 (FIGS. 6 & 7). The position, size and weight of counterbalance 126 is designed to keep the center of gravity of walker 10 as central and as low as possible so that walker 10 is as stable as possible. Counterbalance 126 further reduces the walker's tendency to tip forward when oxygen bottles 124 are inserted or removed from tank supports 122.

In use, walker 110 is set up by inserting a bottom end 124*b* (FIG. 7) of an oxygen bottle 124 through one of ring supports 132 and then into the aligned cupped support 130. During insertion of bottles 124, counterbalance 126 maintains walker 110 in a stable and upright position. Ring support 132 and cupped support 130 hold the oxygen bottles 124 in a substantially vertical position. Bottles 124 may then be hooked up via hoses (not shown) for the user to obtain oxygen therefrom. The user (not shown) grasps handles 121 and pushes walker 110 in the direction indicated by arrow "C" in FIG. 6. When they have walked a distance and are tired, they can stop the forward motion of walker 110 by engaging braking system 158 and sit down on seat 160. Handles 121 can be grasped to assist the user in lowering themselves into seat 160 or when they get up when they are ready to continue walking. When the user is seated in seat 160, oxygen bottles 124 provide a backrest to seat 160, thereby allowing the user to rest themselves more fully. If the user has reached their destination and wishes to collapse walker for transport or storage purposes, the user must first remove oxygen bottles 124 from tank supports 122. When walker 110 is to be used again, the user unfolds the frame 112 and reinserts oxygen bottles 124 into tank supports 122.

It will be understood, that walker 10 and walker 110 preferably are designed to be collapsed for storage, but may be made to be non-foldable. Furthermore, while two sets of tank supports 122 are shown for carrying two oxygen bottles 124, any number of tank supports may be provided on walker 110, but it is desirable that they be located in a position that enhances the stability of the walker. While the preferred embodiments have shown a tank support comprising a coaxially aligned ring support and cupped support, it will be understood that the ring and cupped supports may be replaced with a substantially continuous tubular member without departing from the spirit of the present invention.

While tank supports 22, 122 have been disclosed as a coaxially aligned ring support and cupped support, it will be understood that tank supports may be elongated tubular members having an axial bore into which oxygen bottles are inserted. Alternatively, tank supports 22, 122 may comprise a pair of spaced apart spring-loaded clips which engage the outermost surface of an oxygen bottle.

Other devices, such as poles for supporting intravenous bags may be provided on walker 10 with consideration being given to evenly distributing weight over walker 10 to provide it with the greatest possible stability.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A walker for assisting physically challenged persons to be mobile, the walker comprising:

a frame having a front end and a rear end;

wheels mounted on the frame to allow the walker to be moved over a surface;

a first tank support mounted on the frame proximate the front end thereof and adapted to receive an oxygen bottle therein; wherein the first tank support comprises a pair of coaxially aligned, spaced apart first and second supports each adapted to engage an outer surface of an oxygen bottle, said first and second supports being connected together by a bar that is mounted on the frame by at least one clamping member; and wherein the clamping member includes;

an arm; and a pair of plates mounted on said arm, the plates being movable toward each other to engage a portion of the frame of the walker; and the plates being movable away from each other to release said portion of the frame of the walker; and a counterbalance mounted on the frame proximate a rear end thereof and a spaced distance from the first tank support; whereby the stability of the walker during motion is enhanced.

2. The walker as set forth in claim 1, wherein the plates are both substantially "V" shaped; and the apexes of the "V"'s lie distant from each other thereby forming a substantially diamond shaped aperture between the plates.

3. The walker as set forth in claim 1, wherein the plates are linked together by bolts; and wherein the movement of the plates is controlled by turning the bolts in one of a first direction and an opposing second direction.

4. The walker as set forth in claim 1, wherein the arm includes an axial bore and the arm is secured to the bar of the first tank support by way of a fastener received within said axial bore.

5. The walker as set forth in claim 1, wherein the counterbalance comprises a pair of first and second weights that are secured to the rear end of the frame in spaced apart relation to each other.

6. The walker as set forth in claim 1, wherein the first support comprises a ring having a central aperture through which the oxygen bottle is inserted and the second support comprises a cupped receptacle adapted to receive a bottom end of the oxygen bottle therein.

7. The walker as set forth in claim 1, further comprising a second tank support disposed a spaced distance away from the first tank support and adapted to receive a second oxygen bottle therein.

8. The walker as set forth in claim 1, wherein the frame is collapsible.

9. A walker for assisting physically challenged persons to be mobile, the walker comprising:

a frame having a single front leg and first and second rear legs; said frame further including a first lowermost strut extending between the front leg and the first rear leg, and a second lowermost strut extending between the front leg and the second rear leg;

a wheel mounted on a lower end of each of the legs of the frame to allow the walker to be moved over a surface;

a tank support mounted on the front leg of the frame and adapted to receive at least one oxygen bottle therein;

a first counterbalance mounted on one of the first and second lowermost struts and a spaced distance from the tank support; whereby the stability of the walker during motion is enhanced.

10. The walker as set forth in claim 9, further comprising a second counterbalance and wherein said first counterbalance is mounted on the first lowermost strut and the second counterbalance is mounted on the second lowermost strut.

11. The walker as set forth in claim 9, wherein the tank support is mounted on the front leg by way of a first clamping member.

12. The walker as set forth in claim 11, wherein the tank support is further secured to at least one of the first and second lowermost struts by a second clamping member.

13. The walker as set forth in claim 9, wherein the first counterbalance is a tubular weight that is secured to the one of the first and second lowermost struts by one of securing bands, welds and bolts.

14. The walker as set forth in claim 9, wherein the first counterbalance is secured to the one of the first and second lowermost struts by one of securing bands, welds or bolts.

15. The walker as set forth in claim 9, wherein the tank support comprises a pair of coaxially aligned, spaced apart first and second supports adapted to engage an outer surface of an oxygen bottle.

16. The walker as set forth in claim 15, wherein the first support comprises a ring having a central aperture through which the oxygen bottle is inserted.

17. The walker as set forth in claim 16, wherein the second support comprises a cupped receptacle adapted to receive a bottom end of the oxygen bottle therein.

18. The walker as set forth in claim 15, wherein the first and second supports are connected together by a bar.

19. The walker as set forth in claim 18, wherein the bar is mounted to the frame by at least one clamping member.

20. The walker as set forth in claim 9, wherein the frame is collapsible.

* * * * *